US008130181B2

(12) United States Patent
Jeon et al.

(10) Patent No.: US 8,130,181 B2
(45) **Date of Patent: *Mar. 6, 2012**

(54) LUMINESCENCE DISPLAY AND DRIVING METHOD THEREOF

(75) Inventors: Chang Hoon Jeon, Gyeongsangbuk-do (KR); Jung Chul Kim, Gyeongsangbuk-do (KR); Ho Young Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 584 days.

This patent is subject to a terminal disclaimer.

(21) Appl. No.: 12/314,701

(22) Filed: Dec. 15, 2008

(65) Prior Publication Data

US 2009/0167648 A1 Jul. 2, 2009

(30) Foreign Application Priority Data

Dec. 27, 2007 (KR) ..... 10-2007-0138359

(51) Int. Cl.
*G09G 3/30* (2006.01)

(52) U.S. Cl. ..... 345/78; 345/77; 345/82; 345/84; 345/208; 345/214; 315/169.3

(58) Field of Classification Search ..... 345/82–83, 345/76–78, 84, 204–205, 214, 208; 315/169.3, 315/167; 313/463
See application file for complete search history.

(56) References Cited

U.S. PATENT DOCUMENTS

| | | | | |
|---|---|---|---|---|
| 2006/0023551 | A1* | 2/2006 | Peng et al. | 365/226 |
| 2006/0262130 | A1* | 11/2006 | Kim et al. | 345/589 |
| 2006/0267885 | A1* | 11/2006 | Kwak et al. | 345/76 |
| 2007/0040772 | A1 | 2/2007 | Kim et al. | |

FOREIGN PATENT DOCUMENTS

| | | |
|---|---|---|
| CN | 1447302 | 10/2003 |
| CN | 1693942 | 11/2005 |
| CN | 1734546 | 2/2006 |
| CN | 1758314 | 4/2006 |
| CN | 1917015 | 2/2007 |
| WO | WO 2007/138729 A1 | 12/2007 |

* cited by examiner

*Primary Examiner* — Lun-Yi Lao
*Assistant Examiner* — Md Saiful A Siddiqui
(74) *Attorney, Agent, or Firm* — McKenna Long & Aldridge, LLP.

(57) ABSTRACT

A OLED display and a driving method thereof are disclosed. The OLED display includes: an OLED display panel including: data lines to which data voltages are supplied; gate lines to which a gate voltage is sequentially supplied; luminescence control lines to which a luminescence control voltage is sequentially supplied, a driving power line to which a driving voltage is supplied; a compensation power line to which a compensation voltage having a first level and a second level different from the first level are supplied; a plurality of pixel cells each respectively in pixel areas defined by the data lines and the gate lines; a data driver having output lines whose number is smaller than the number of the data lines; and a demultiplexer unit formed between the data driver and the OLED display panel, the demultiplexer unit supplying the data voltages from the output lines to the data lines, wherein each of the pixel cells includes: a light emitting element; and a pixel driver that supplies a current corresponding to a corresponding one of the data voltages to the light emitting element based on the corresponding data voltage, the gate voltage, the luminescence control voltage, the driving voltage and the compensation voltage having the first level and that turns off the light emitting element when the compensation voltage has the second level.

20 Claims, 12 Drawing Sheets

LUMINESCENCE DISPLAY AND DRIVING METHOD THEREOF

This application claims the benefit of the Korean Patent Application No. 2007-138359, filed on Dec. 27, 2007, which is hereby incorporated by reference for all purposes as if fully set forth herein.

BACKGROUND OF THE INVENTION

1. Field of the Invention

The present invention relates to a luminescence display and a driving method thereof, and more particularly, to a luminescence display which is capable of reducing the number of output lines of a data driver, and a driving method thereof.

2. Discussion of the Related Art

An active matrix type organic electro-luminescence display (OLED) includes a plurality of pixel cells arranged in a matrix in order to display images. As shown in FIG. 1, each pixel cell 10 of the organic electro-luminescence display includes, an organic light emitting diode (OLED) and a pixel driver 12 for driving the OLED independently. The OLED has a cathode electrode connected to the pixel driver 12, an anode electrode connected to a power line PL, and an organic layer formed between the cathode electrode and the anode electrode. The pixel driver 12 is connected to a gate line GL that supplies a gate signal, a data line DL that supplies a data signal, and the power line PL that supplies a power signal VDD. The pixel driver includes a switching transistor ST, a driving transistor DT, and a storage capacitor Cst connected among the gate line GL, data line DL, and power line PL as shown in FIG. 1. With this configuration, the pixel driver 12 drives the OLED.

A data driver, which supplies a data voltage to each data line DL of this OLED display, has output lines corresponding to each of the data lines DL. For this reason, as the OLED display increases in resolution, the data lines DL thereof also increase in number, resulting in an increase in the number of the output lines. As a result, the number of costly data driving integrated circuits (ICs) constituting the data driver not only increases, but processing time and manufacturing cost required for attaching the data driving ICs increases, which lead to an increase in the entire cost of the OLED display.

SUMMARY OF THE INVENTION

Accordingly, the present invention is directed to a luminescence display and a driving method thereof that substantially obviate one or more problems due to limitations and disadvantages of the related art.

An advantage of the present invention is to provide a luminescence display which is capable of reducing the number of output lines of a data driver, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described, a OLED display includes: an OLED display panel including: data lines to which data voltages are supplied; gate lines to which a gate voltage is sequentially supplied; luminescence control lines to which a luminescence control voltage is sequentially supplied, a driving power line to which a driving voltage is supplied; a compensation power line to which a compensation voltage having a first level and a second level different from the first level are supplied; a plurality of pixel cells each respectively in pixel areas defined by the data lines and the gate lines; a data driver having output lines whose number is smaller than the number of the data lines; and a demultiplexer unit formed between the data driver and the OLED display panel, the demultiplexer unit supplying the data voltages from the output lines to the data lines, wherein each of the pixel cells includes: a light emitting element; and a pixel driver that supplies a current corresponding to a corresponding one of the data voltages to the light emitting element based on the corresponding data voltage, the gate voltage, the luminescence control voltage, the driving voltage and the compensation voltage having the first level and that turns off the light emitting element when the compensation voltage has the second level.

In another aspect of the present invention, a driving method for an OLED display, the OLED display including an OLED display panel having a plurality of pixel cells formed respectively in pixel areas defined by data lines to which data voltages are supplied, gate lines to which a gate voltage is sequentially supplied, luminescence control lines to which a luminescence control voltage is sequentially supplied, a driving power line to which a driving voltage is supplied, and a compensation power line to which compensation voltages of a first level and a second level different from the first level are supplied, the method including: supplying the data voltages from a data driver to the data lines through a demultiplexer unit between the data driver and the OLED display panel, the data driver having output lines whose number is smaller than the number of the data lines; sequentially supplying the gate voltage to the gate lines; supplying current corresponding to a corresponding one of the data voltages to a light emitting element of each of the pixel cells based on the luminescence control voltage, the driving voltage and the compensation voltage with the first level to turn on the light emitting element; and turning off the light emitting element based on the compensation voltage with the second level.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
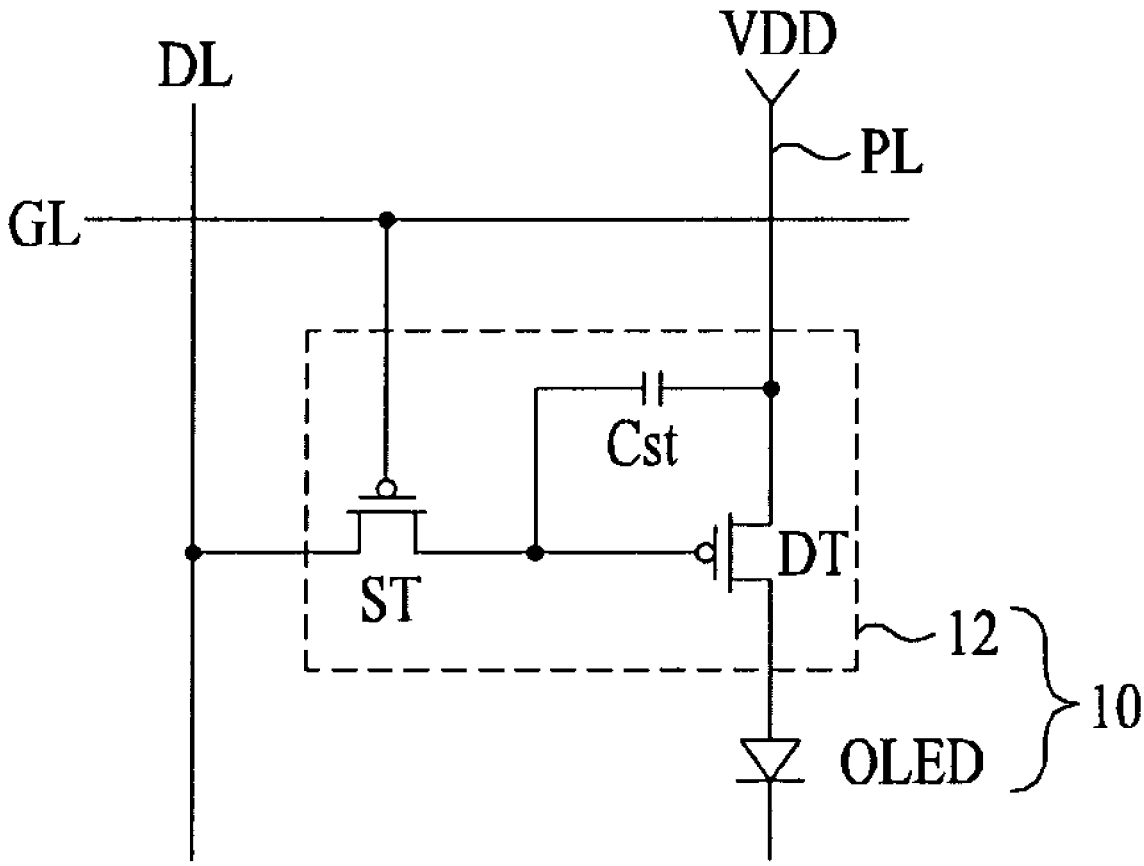
FIG. 1 Related Art
FIG. 1 is a circuit diagram of a pixel cell of a related art OLED display.
Figure 2:
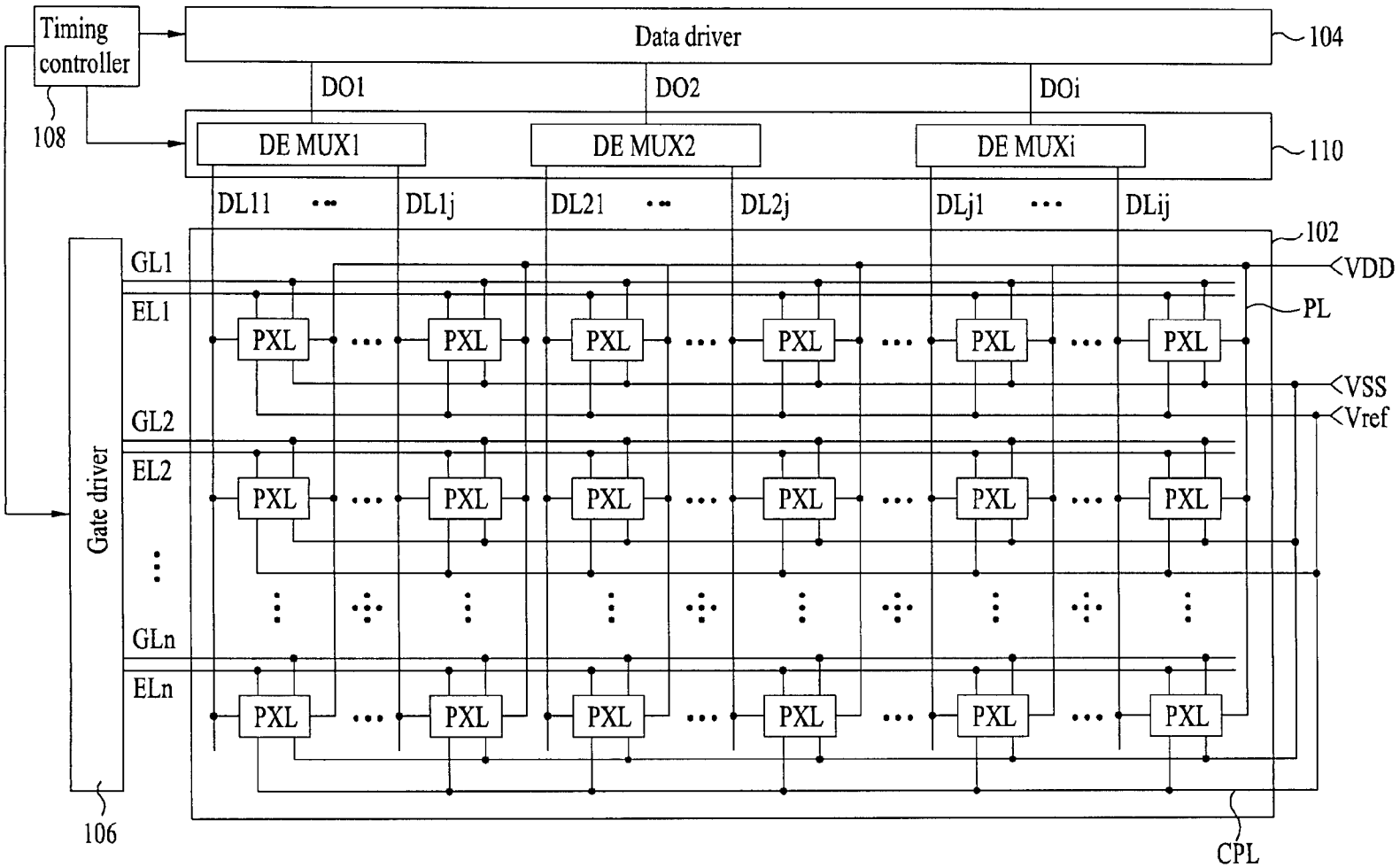
FIG. 2 is a block diagram showing the configuration of an OLED display according to a first embodiment of the present invention.

FIG. 2 is a block diagram showing the configuration of an OLED display according to a first embodiment of the present invention.

Referring to FIG. 2, the OLED display according to the first embodiment of the present invention includes an OLED display panel 102, a gate driver 106 that drives gate lines GL1 to GLn of the OLED display panel 102, a data driver 104 that drives data lines DL11 to DLij of the OLED display panel 102, a demultiplexer unit 110 connecting the data driver 104 to the OLED display panel 102, and a timing controller 108 that controls the gate driver 106, data driver 104, and demultiplexer unit 110.

The OLED display panel 102 displays an image using a plurality of pixel cells PXL connected to the data lines DL, the gate lines GL, luminescence control lines EL, a driving power line PL, and a compensation power line CPL.

Figure 3:
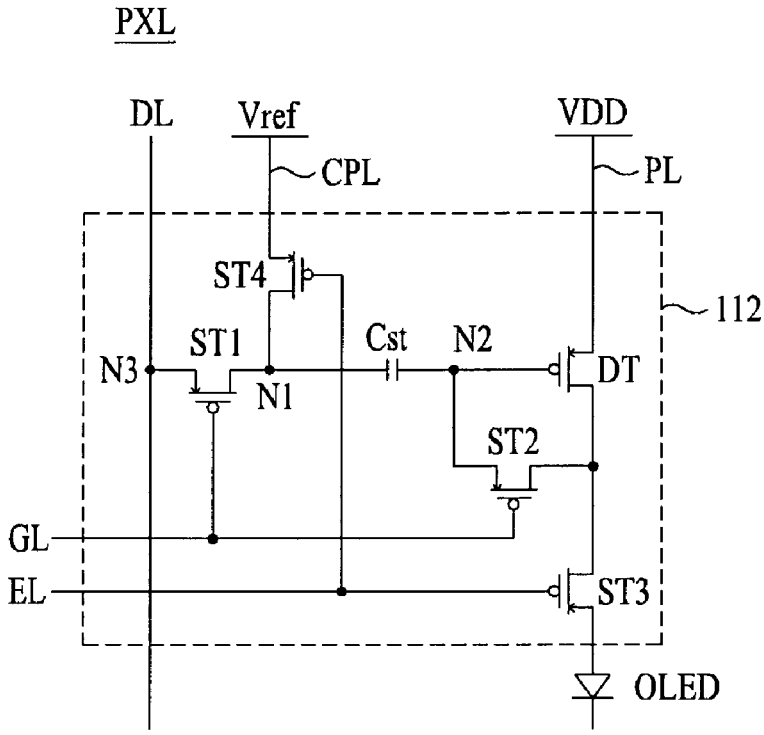
FIG. 3 is a detailed circuit diagram of a pixel cell shown in FIG. 2.

Each pixel cell PXL includes, as shown in FIG. 3, an OLED, and a pixel driver 112 for driving the OLED.

The pixel driver 112 includes first to fourth switching transistors ST1 to ST4, a driving transistor DT, and a storage capacitor Cst.

The first switching transistor ST1 supplies a data signal Vdata from a corresponding data line DL to a first node N1 in response to a gate voltage indicating a low logic level from a corresponding gate line GL, so as to charge the data signal Vdata in the storage capacitor Cst.

The second switching transistor ST2 interconnects the gate electrode and drain electrode of the driving transistor DT in response to the low-logic gate voltage from the gate line GL to operate the driving transistor DT as a diode.

The third switching transistor ST3 connects the drain electrode of the driving transistor DT to the anode electrode of the OLED in response to a luminescence control voltage indicating a low logic level from a corresponding luminescence control line EL. That is, the third switching transistor ST3 supplies current output from the driving transistor DT to the OLED in response to the low-logic luminescence control voltage.

The fourth switching transistor ST4 supplies a compensation voltage Vref from the compensation power line CPL to the first node N1 in response to the low-logic luminescence control voltage from the luminescence control line EL.

The driving transistor DT controls the amount of current flowing to the OLED in response to a voltage at a second node N2.

The capacitor Cst is formed between the first node N1 and the second node N2 to store a difference voltage between the first node N1 and the second node N2 and maintain the ON state of the driving transistor DT for a period of one frame using the stored voltage when the first switching transistor ST1 is turned off.

The OLED has an anode electrode connected to the pixel driver 112, a cathode electrode connected to a low-level voltage VSS, and an organic layer formed between the anode electrode and the cathode electrode. This OLED emits light by current flowing from the driving transistor DT through the third switching transistor ST3 of the pixel driver 112.

The timing controller 108 generates a plurality of control signals to control the driving timing of the gate driver 106 and data driver 104, arranges pixel data, and supplies the arranged pixel data to the data driver 104. Also, the timing controller 108 generates a plurality of sampling control signals to control the demultiplexer unit 110.

The gate driver 106 sequentially supplies a gate voltage indicating a low logic state to the gate lines GL1 to GLn. As a result, the gate driver 106 turns on the first and second switching transistors ST1 and ST2 connected to the gate lines GL1 to GLn on a gate line basis. This gate driver 106 supplies a gate voltage indicating a low logic state for a scan period of one horizontal period and supplies a gate voltage indicating a high logic state for a data input period of the one horizontal period. Accordingly, a data voltage is not supplied to each pixel cell for the data input period of the one horizontal period, and the data voltage is supplied to each pixel cell for the scan period of the one horizontal period.

Also, the gate driver 106 sequentially supplies a luminescence control voltage indicating a low logic state to the luminescence control lines EL1 to ELn.

The data driver 104 supplies data voltages Vdata for one horizontal line to the demultiplexer unit 110 in the data input period of the one horizontal period. This data driver 104 has a smaller number of output lines than the number of data lines DL and equal to the number of demultiplexers DEMUX in the demultiplexer unit 110.

The demultiplexer unit 110 supplies data voltages to the data lines DL for the data input period of the one horizontal period. To this end, the demultiplexer unit 110 includes a plurality of demultiplexers DEMUX1 to DEMUXi connected between the data driver 104 and the OLED display panel 102.

Each of the demultiplexers DEMUX1 to DEMUXi is connected between a corresponding one of the output lines DO1 to DOi of the data driver 104 and corresponding j (where j is a natural number larger than 1) ones DL11 to DL1*j*, DL21 to DL2*j*, . . . , or DLi1 to DLij of the data lines DL. Each of these demultiplexers DEMUX1 to DEMUXi includes first to jth sampling transistors connected respectively to the j data lines DL11 to DL1*j*, DL21 to DL2*j*, . . . , or DLi1 to DLij. In the present invention as an example, a description will be given of the case where each of the demultiplexers DEMUX1 to DEMUXi includes three sampling transistors for supplying red (R), green (G) and blue (B) data voltages Vdata, respectively. In this case, the number of the output lines DO of the data driver 104 is ⅓ that of the data lines DL.

Figure 4:
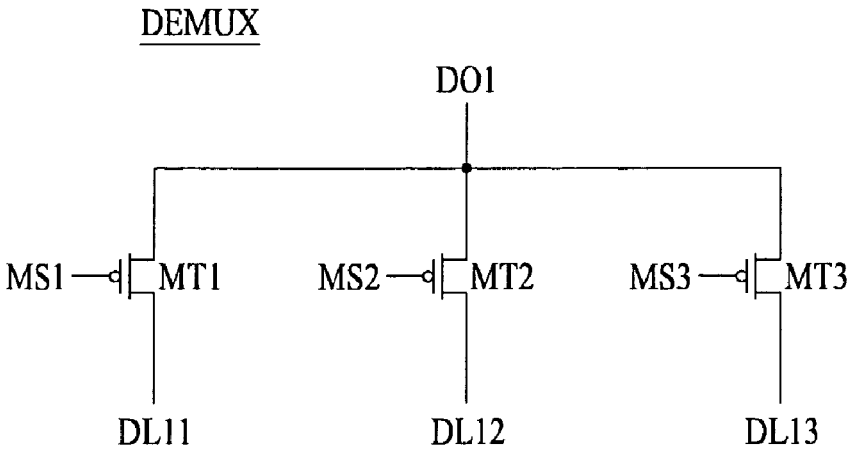
FIG. 4 is a detailed circuit diagram of a demultiplexer shown in FIG. 2.

Each of the demultiplexers DEMUX1 to DEMUXi includes, as shown in FIG. 4, first to third sampling transistors MT1 to MT3 connected in parallel to the corresponding output line DO of the data driver 104.

The first to third sampling transistors MT1 to MT3 are turned on at different times, respectively, in response to sampling control signals MS1 to MS3 supplied from the timing controller 108. That is, the first sampling transistors MT1 of the first to ith demultiplexers DEMUX1 to DEMUXi supply red data voltages from the output lines DO1 to DOi of the data driver 104, respectively, to a first group of data lines DL11, DL21, . . . , DLi1 connected respectively to first output terminals of the first to ith demultiplexers DEMUX1 to DEMUXi in response to the first sampling control signal MS1. The second sampling transistors MT2 of the first to ith demultiplexers DEMUX1 to DEMUXi supply green data voltages from the output lines DO1 to DOi of the data driver 104, respectively, to a second group of data lines DL12, DL22, . . . , DLi2 connected respectively to second output terminals of the first to ith demultiplexers DEMUX1 to DEMUXi in response to the second sampling control signal MS2. The third sampling transistors MT3 of the first to ith demultiplexers DEMUX1 to DEMUXi supply blue data voltages from the output lines DO1 to DOi of the data driver 104, respectively, to a third group of data lines DL13, DL23, . . . , DLi3 connected respectively to third output terminals of the first to ith demultiplexers DEMUX1 to DEMUXi in response to the third sampling control signal MS3.

Figure 5:
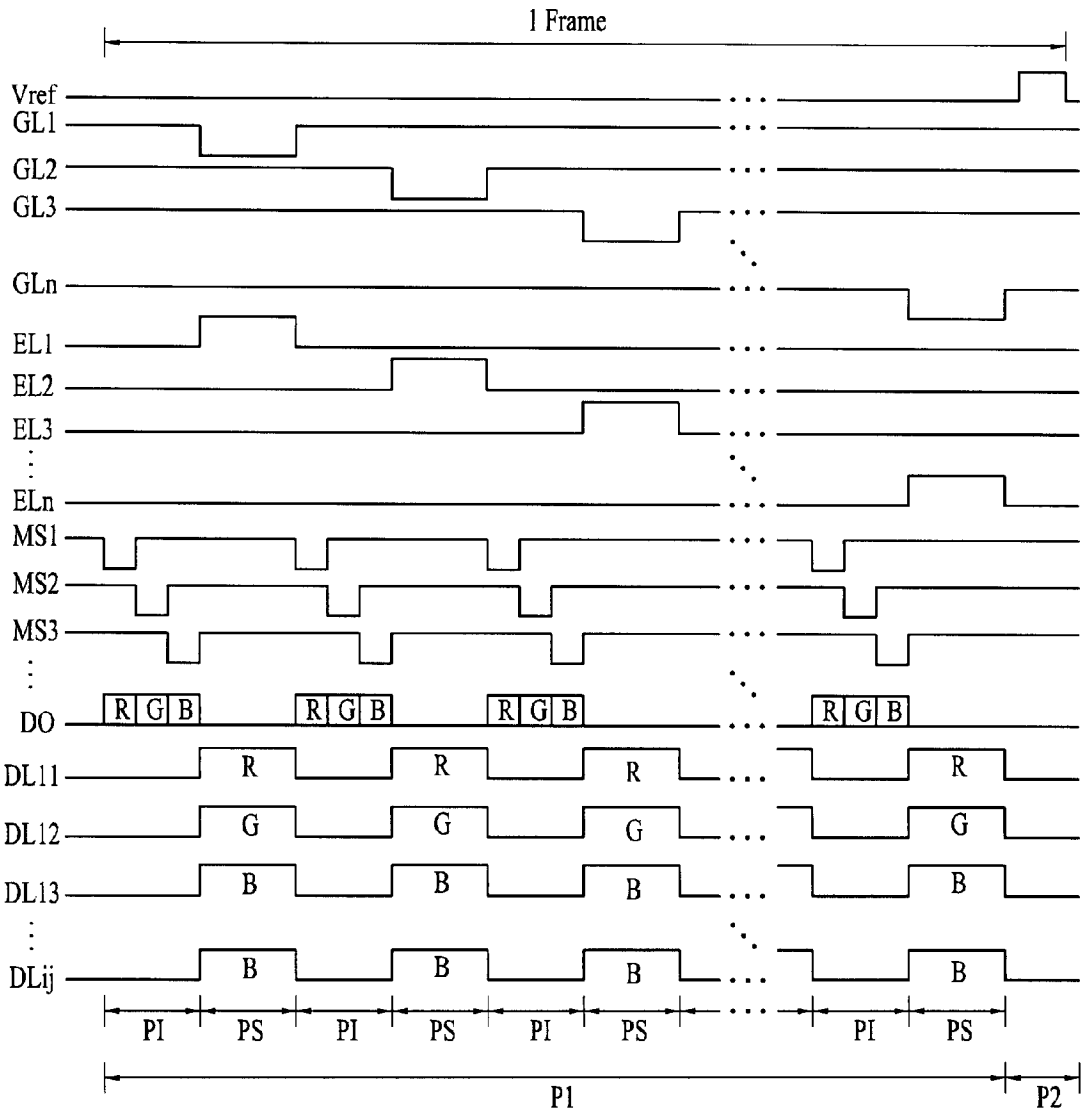
FIG. 5 is a waveform diagram illustrating a driving method of the OLED display according to the first embodiment of the present invention.
Figure 6A:
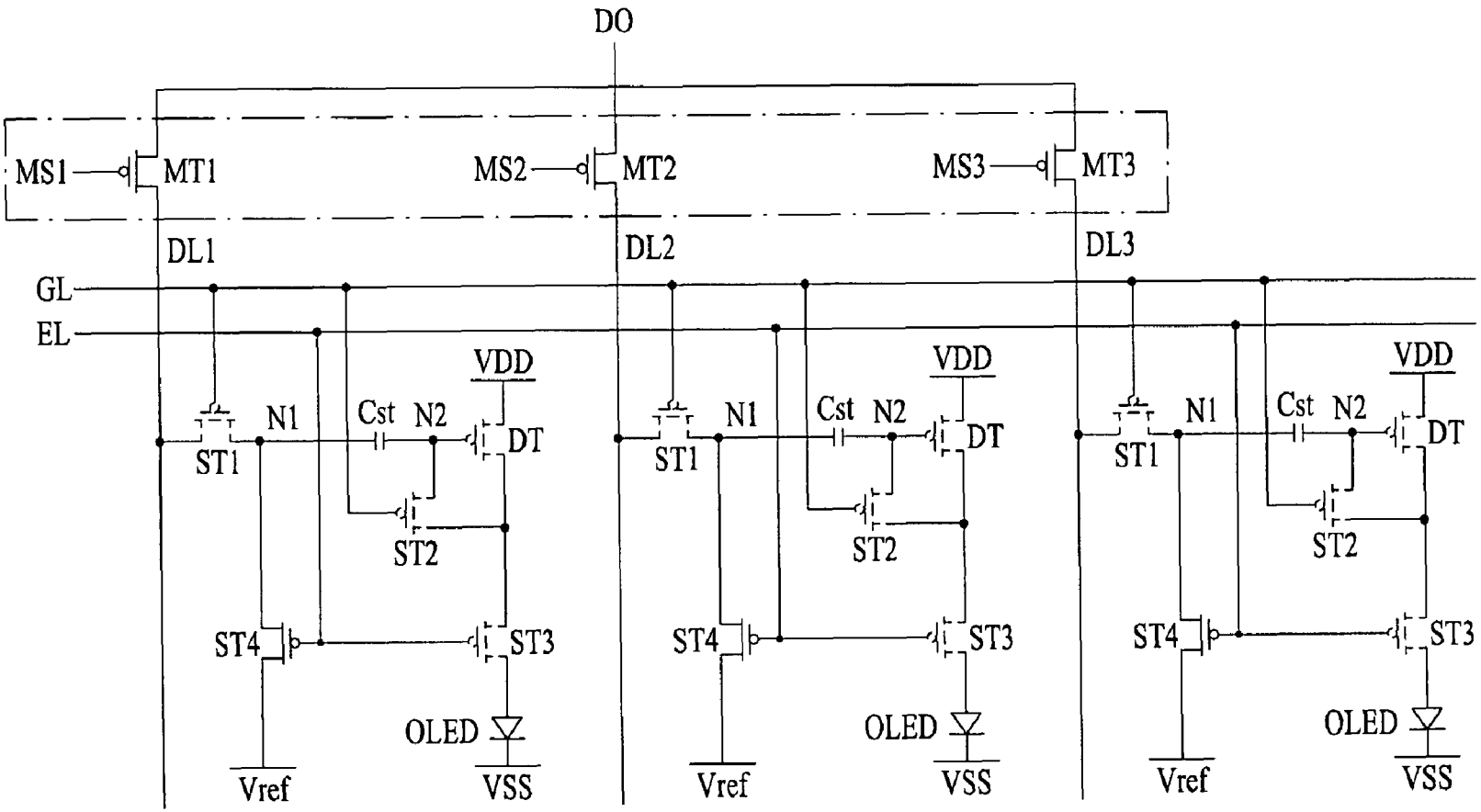
FIGS. 6A to 6C are circuit diagrams illustrating in detail the driving method of the OLED display according to the first embodiment of the present invention.
Figure 6B:
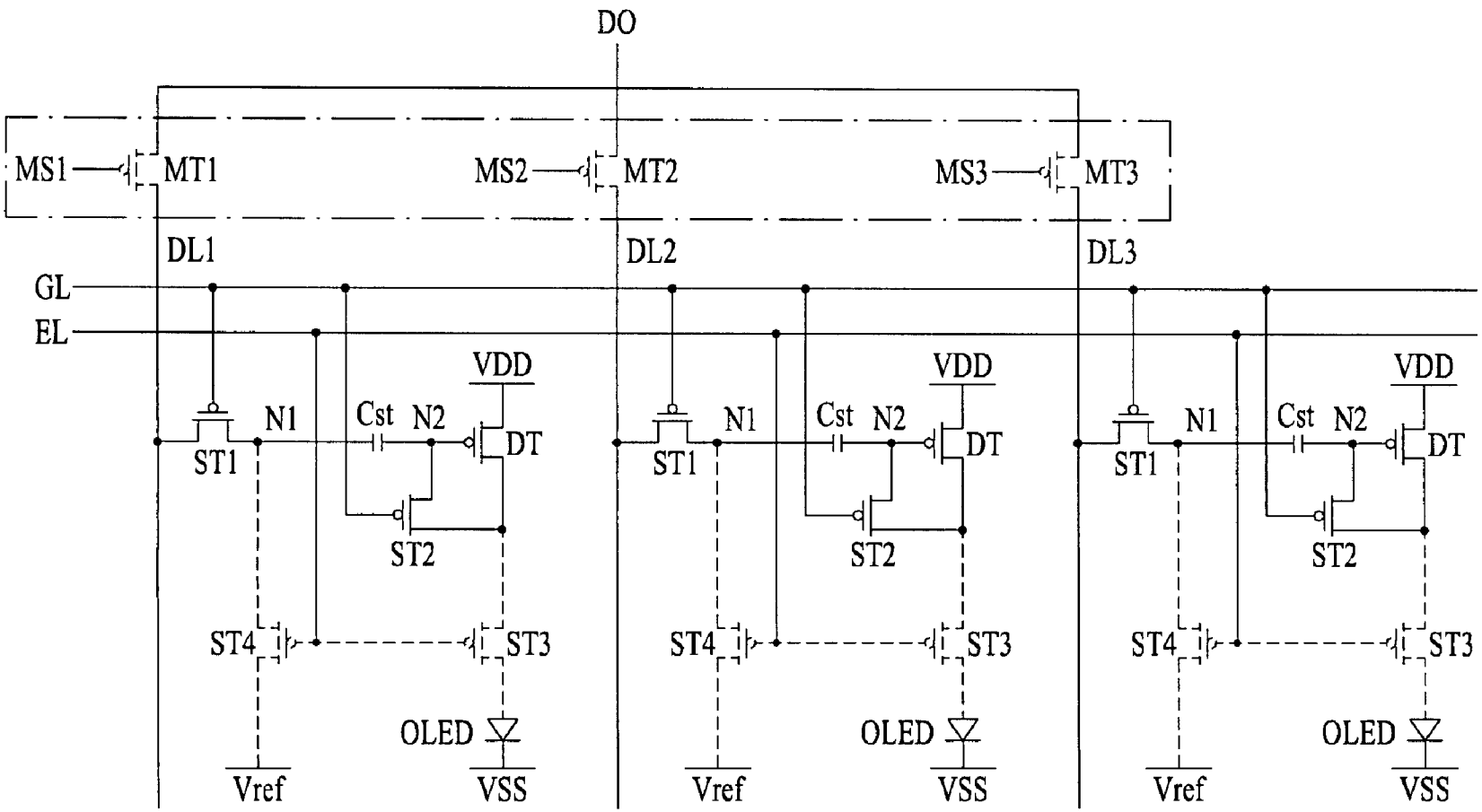
Figure 6C:
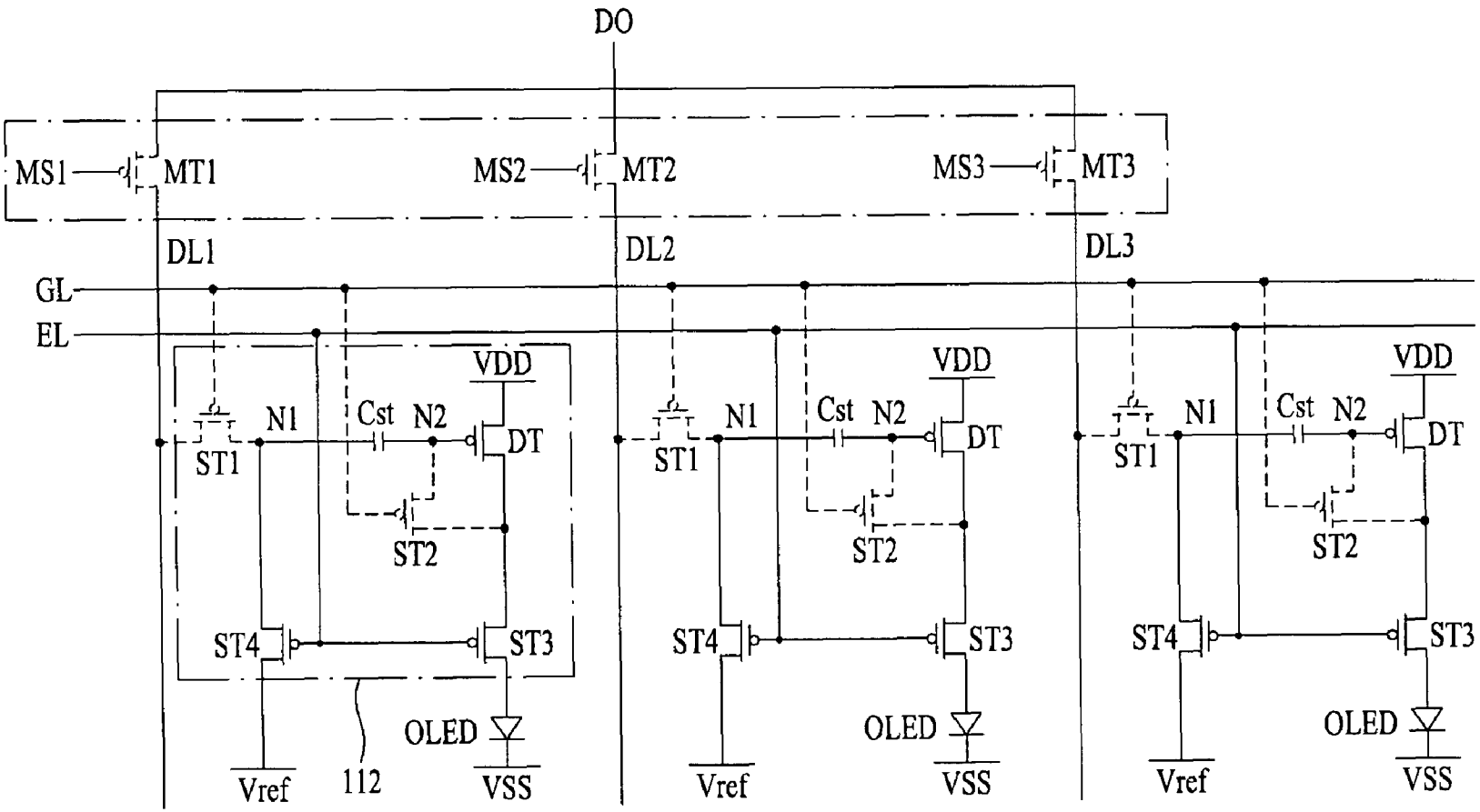

FIG. 5 is a waveform diagram illustrating a driving method of the OLED display according to the first embodiment of the present invention, and FIGS. 6A to 6C are circuit diagrams illustrating in detail the driving method of the OLED display according to the first embodiment of the present invention.

One frame period is divided into a first period P1 where a data input period PI and a scan period PS are alternately repeated, and a second period P2, as shown in FIG. 5.

First, in the data input period PI of the first period P1, the first to third sampling control signals MS1 to MS3 indicating a low logic state are sequentially supplied to the first to third sampling transistors MT1 to MT3. In response to these low-logic sampling control signals MS1 to MS3, the first to third sampling transistors MT1 to MT3 are turned on as shown in FIG. 6A. When the first sampling transistors MT1 are turned on by the first sampling control signal MS1 indicating a low logic state, red data voltages Vdata from the output lines DO1, DO2, . . . , DOi of the data driver 104 are supplied to the first group of data lines DL11, DL21, . . . , DLi1, respectively. Then, when the second sampling transistors MT2 are turned on by the second sampling control signal MS2 indicating a low logic state, green data voltages Vdata from the output lines DO1, DO2, . . . , DOi of the data driver 104 are supplied to the second group of data lines DL12, DL22, . . . , DLi2, respectively. Then, when the third sampling transistors MT3 are turned on by the third sampling control signal MS3 indicating a low logic state, blue data voltages Vdata from the output lines DO1, DO2, . . . , DOi of the data driver 104 are supplied to the third group of data lines DL13, DL23, . . . , DLi3, respectively.

At this time, because the high-logic gate voltage is supplied to the gate lines GL1 to GLn during the data input period PI where the first to third sampling transistors MT1 to MT3 are turned on, the red, green and blue data voltages supplied to the data lines DL are not supplied to the respective pixel cells.

Figure 7:
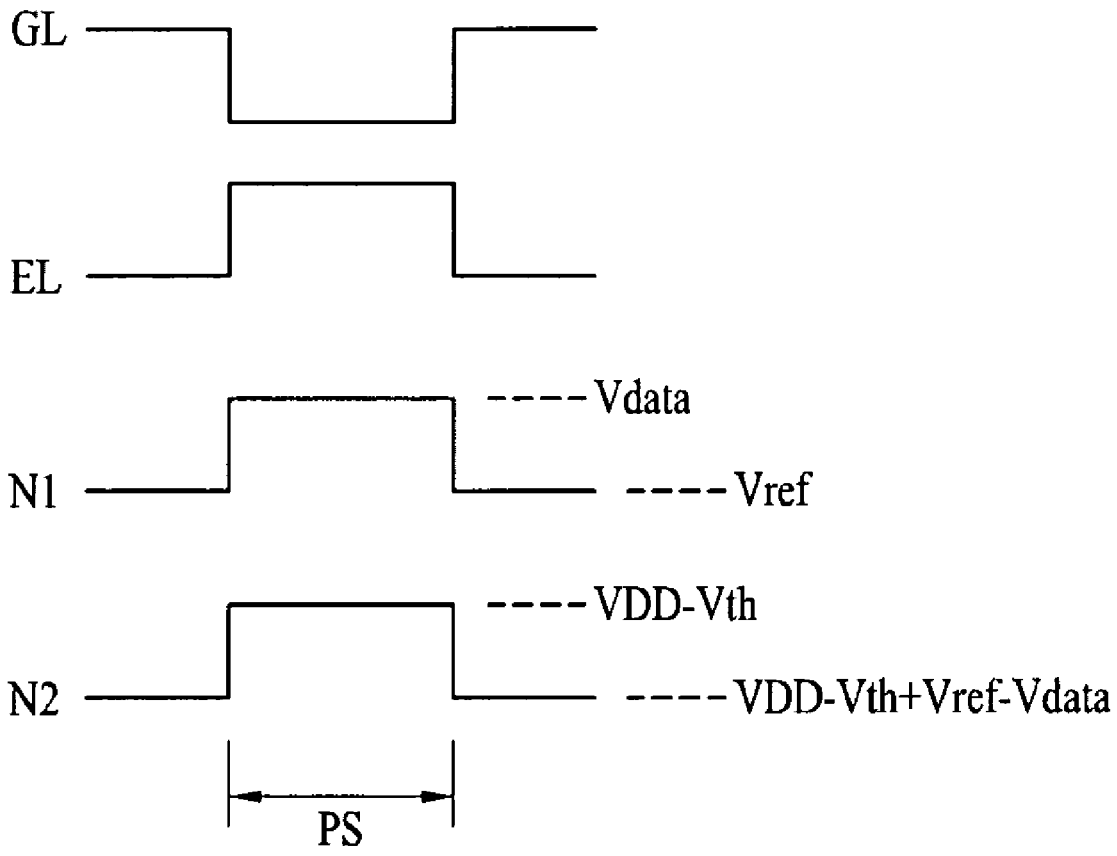
FIG. 7 is a waveform diagram illustrating voltage variations at first and second nodes shown in FIGS. 6A to 6C for a scan period and data input period of the OLED display according to a first embodiment of the present invention.

In the scan period PS, the low-logic gate voltage is supplied to a corresponding gate line GL and the high-logic luminescence control voltage is supplied to a corresponding luminescence control line EL. As a result, the first and second switching transistors ST1 and ST2 are turned on and the third and fourth switching transistors ST3 and ST4 are turned off, as shown in FIG. 6B. A data voltage Vdata from a corresponding data line DL is supplied to the first node N1 through the turned-on first switching transistor ST1. The gate electrode and drain electrode of the driving transistor DT are interconnected through the turned-on second switching transistor ST2. As a result, because the driving transistor DT acts as a forward diode, a threshold voltage Vth_S of the driving transistor DT is supplied to the gate electrode of the driving transistor DT, namely, the second node N2, so that the threshold voltage Vth_S of the driving transistor DT is sampled at the second node N2. At this time, a high-level voltage VDD is supplied to the source electrode of the driving transistor DT. Consequently, a difference voltage (VDD−Vth_S) between the high-level voltage VDD and the threshold voltage Vth_S of the driving transistor DT is supplied to the second node N2, as shown in FIG. 7.

Thereafter, during the data input period of the pixel cell of the next stage, the high-logic gate voltage is supplied to a gate line GL corresponding to the pixel cell of the next stage and the low-logic luminescence control voltage is supplied to a luminescence control line EL corresponding to the pixel cell of the next stage. As a result, the first and second switching transistors ST1 and ST2 are turned off and the third and fourth switching transistors ST3 and ST4 are turned on, as shown in FIG. 6C. A compensation voltage Vref of a first level is supplied to the first node N1 through the turned-on fourth switching transistor ST4.

At this time, a voltage across the capacitor Cst is kept constant because no current path is formed in the pixel driver 112. As a result, a voltage at the second node N2, which is the other terminal of the capacitor Cst, varies by a voltage variation (Vref−Vdata) from the first node N1, which is one terminal of the capacitor Cst. That is, a voltage (VDD−Vth_S+Vref−Vdata) is supplied to the second node N2, as shown in FIG. 7.

Then, the driving transistor DT is turned on by a gate-source voltage thereof. As a result, current supplied from the driving transistor DT to the OLED through the third switching transistor ST3 can be expressed as in the following equation 1. In equation 1, β represents a constant and Vth_R represents a real threshold voltage of the driving transistor DT.

$$I = \beta/2(Vgs - \mathrm{Vth_R})^2 \qquad \text{[Equation 1]}$$
$$= \beta/2(Vdd - \mathrm{Vth_S} + Vc - Vdata - Vdd - \mathrm{Vth_R})^2$$
$$= \beta/2(Vref - Vdata - \mathrm{Vth_S} - \mathrm{Vth_R})^2$$

In the case where the sampled threshold voltage Vth_S of the driving transistor DT and the real threshold voltage Vth_R of the driving transistor DT are the same in the equation 1, the current from the driving transistor DT is determined depending on the compensation voltage Vref and the data voltage Vdata without being influenced by a drop of the high-level voltage VDD and the threshold voltage of the driving transistor DT. As a result, a degradation in picture quality due to hysteresis of the driving transistor DT is minimized.

In contrast, in the case where the sampled threshold voltage Vth_S of the driving transistor DT and the real threshold voltage Vth_R of the driving transistor DT are different in the equation 1, the current from the driving transistor DT is influenced by the sampled threshold voltage Vth_S of the driving transistor DT and the real threshold voltage Vth_R of the driving transistor DT. In this case, the hysteresis of the driving transistor DT increases and the picture quality is degraded due to an afterimage resulting from the increasing hysteresis. For this reason, in the second period P2 of every frame, a compensation voltage Vref with a second level higher than the first level is supplied to the fourth switching transistor ST4. As a result, the compensation voltage Vref with the second voltage level is supplied to the first node N1 through the fourth switching transistor ST4, so that a voltage at the second node N2 varies by a voltage variation at the first node N1 based on the compensation voltage Vref with the second level. The driving transistor DT is turned off by the varying voltage at the second node N2, thereby causing a black image to be displayed on the OLED display panel 102 for the second period P2. In this case, in the second period P2 of each frame, the electric field direction on the driving transistor DT is changed by the compensation voltage Vref of the second level to reduce the amount of charge that is trapped by the driving transistor DT, so as to prevent the hysteresis of the driving transistor DT from increasing.

In this manner, in the OLED display according to the present invention, data voltages sequentially supplied through one output line are supplied to a plurality of data lines using the demultiplexer unit. The data voltages supplied to the plurality of data lines are simultaneously supplied to the respective pixel cells through the first switching transistors. Therefore, it is possible to display an image with even brightness.

Figure 8:
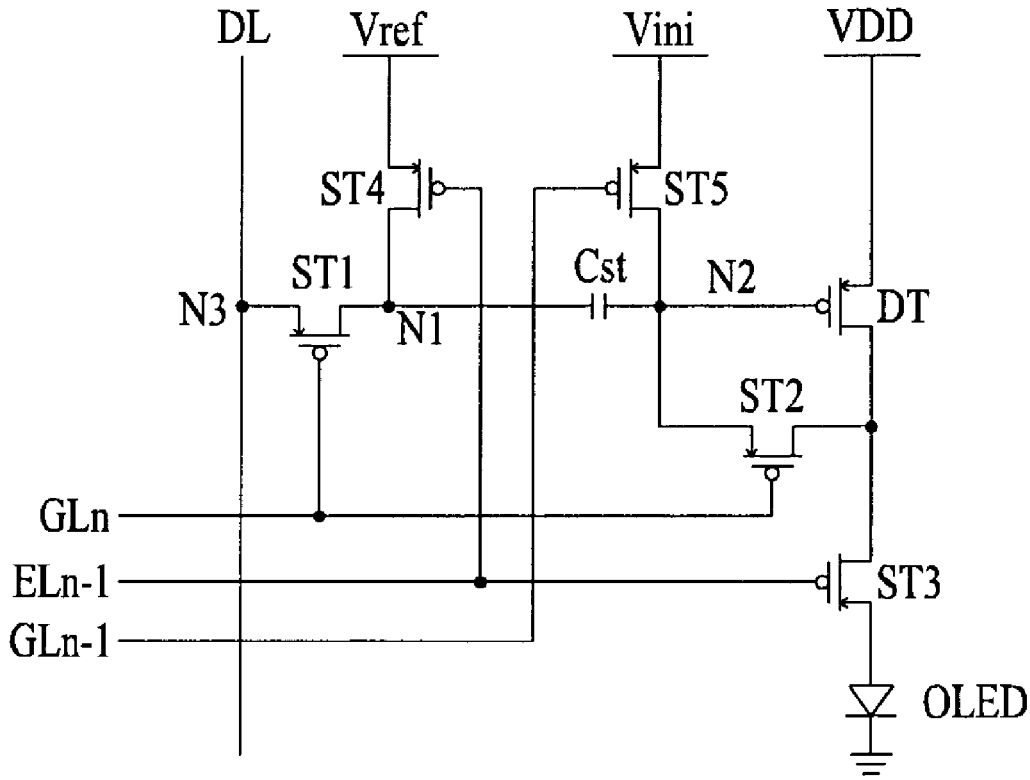
FIG. 8 is a circuit diagram of each pixel cell of an OLED display according to a second embodiment of the present invention.

FIG. 8 is a circuit diagram of a pixel structure of an OLED display according to a second embodiment of the present invention.

The pixel structure of the OLED display shown in FIG. 8 is the same as the pixel structure of the OLED display shown in FIG. 3, with the exception that it further includes a fifth switching transistor ST5 for supplying an initialization voltage Vini to the second node N2. Therefore, a detailed description of the same constituent elements will be omitted.

The fifth switching transistor ST5 supplies the initialization voltage Vini to the second node N2 in response to the low-logic gate voltage supplied to the gate line GLn-1 of the previous stage to initialize each pixel cell along a horizontal line. This fifth switching transistor ST5 has a gate terminal connected to the gate line GLn-1 of the previous stage, a source terminal connected to an initialization voltage Vini source, and a drain terminal connected to the second node N2. Here, the initialization voltage Vini is set to be lower than a voltage obtained by subtracting the threshold voltages Vth of the transistors included in the pixel driver 112 from the high-level voltage VDD.

Figure 9:
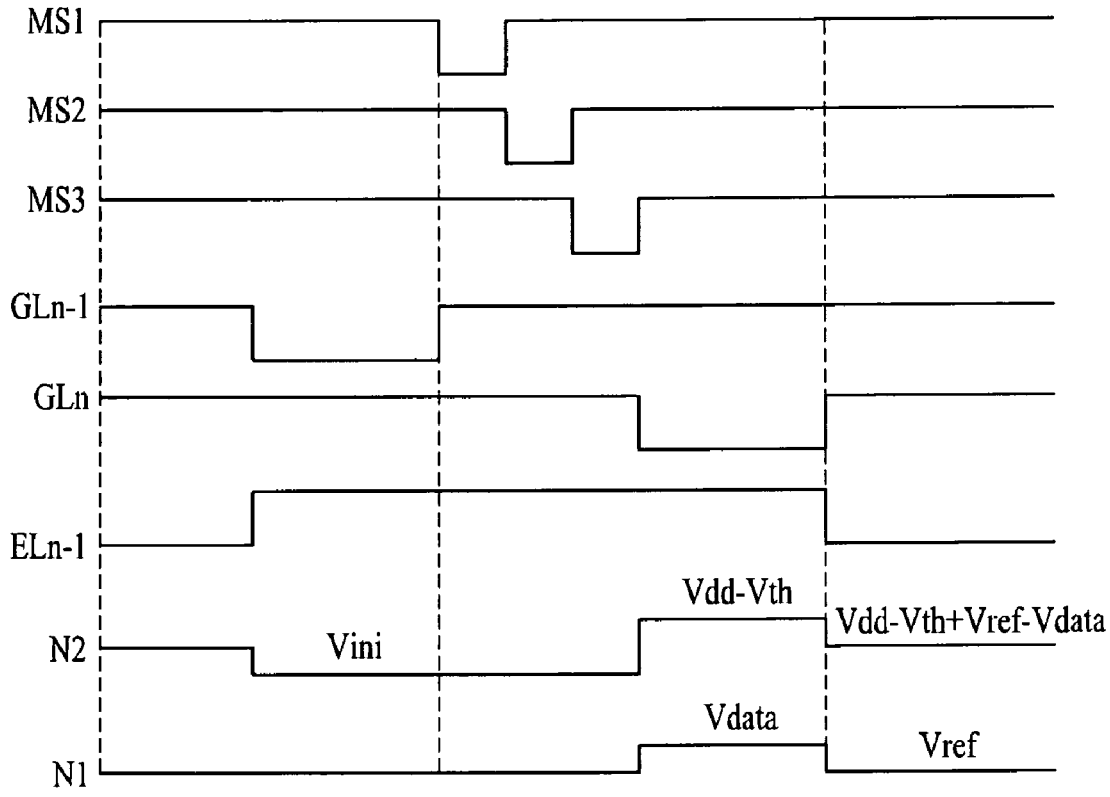
FIG. 9 is a waveform diagram illustrating voltage variations at first and second nodes shown in FIG. 8 for a scan period and data input period of the OLED display according to the second embodiment of the present invention.

In an initialization period using the fifth switching transistor ST5, the low-logic gate voltage is supplied to the gate line GLn-1 of the previous stage and the high-logic luminescence control voltage is supplied to the luminescence control line ELn-1 of the previous stage, as shown in FIG. 9.

As a result, the fifth switching transistor ST5 is turned on in response to the low-logic gate voltage, whereas the third switching transistor ST3 is turned off in response to the high-logic luminescence control voltage. The initialization voltage Vini is supplied to the second node N2 through the turned-on fifth switching transistor ST5, thereby causing the gate terminal of the driving transistor DT to be initialized with the initialization voltage Vini. Therefore, it is possible to prevent the threshold value of the driving transistor DT from increasing because of signals with a single polarity so as to prevent the driving transistor DT from deteriorating. That is, the driving transistor DT restores the threshold voltage thereof to its initial state. On the other hand, the direction of the initialization path is different from the direction of current flowing to the OLED, thereby preventing a phenomenon that a black brightness level increases due to a leakage current.

As described above, in the OLED display according to the present invention, data voltages sequentially supplied through one output line are supplied to a plurality of data lines using the demultiplexer unit. The data voltages supplied to the plurality of data lines are simultaneously supplied to the respective pixel cells through the first switching transistors, so that an image with even brightness may be displayed.

Figure 10:
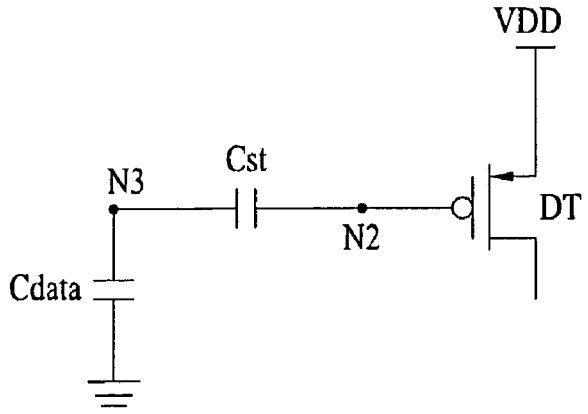
FIG. 10 is a circuit diagram illustrating a relationship between a data line capacitor and a storage capacitor for each of the OLEDs according to the first and second embodiments of the present invention.

On the other hand, in the OLED displays and the driving methods thereof according to the first and second embodiments of the present invention, during the scan period, sampling control signals indicating a high logic level are supplied to the first to third sampling transistors MT1, MT2 and MT3. As a result, the demultiplexers DEMUX are isolated from the data lines DL, so that a data voltage Vdata supplied to each data line DL floats as shown in FIG. 10. Consequently, a voltage at a third node N3 is subject to variation, resulting in an input data distortion due to unevenness of the threshold voltages of the driving transistors DT between adjacent pixel cells. Here, the voltage variation at the third node N3 may be determined by the following equation 2.

$$\Delta V_{N3} = \Delta V_{N2} \times \frac{Cst}{Cdata + Cst} \quad \text{[Equation 2]}$$

In equation 2, $\Delta V_{N2}$ represents a voltage variation at the second node N2 resulting from unevenness of the threshold voltage of the driving transistor DT, $\Delta V_{N3}$ represents a voltage variation at the third node N3, Cst represents the capacitance of the storage capacitor Cst, and Cdata represents the self-capacitance of the data line DL.

When the capacitance Cdata of the data line DL is ten times or more as large as the capacitance of the storage capacitor Cst, the input data distortion resulting from the voltage variation at the third node N3 is so negligibly small as to be 1/10th the unevenness of the threshold voltage of the driving transistor DT.

On the other hand, during a period between the scan period PS of the gate line GLn-1 of the previous stage and the scan period PS of the gate line GLn of the current stage, namely, in the data input period, data voltages are supplied to the data lines DL in a time division manner, so that a voltage at the first node N1 is even for every pixel cell.

Figure 11A:
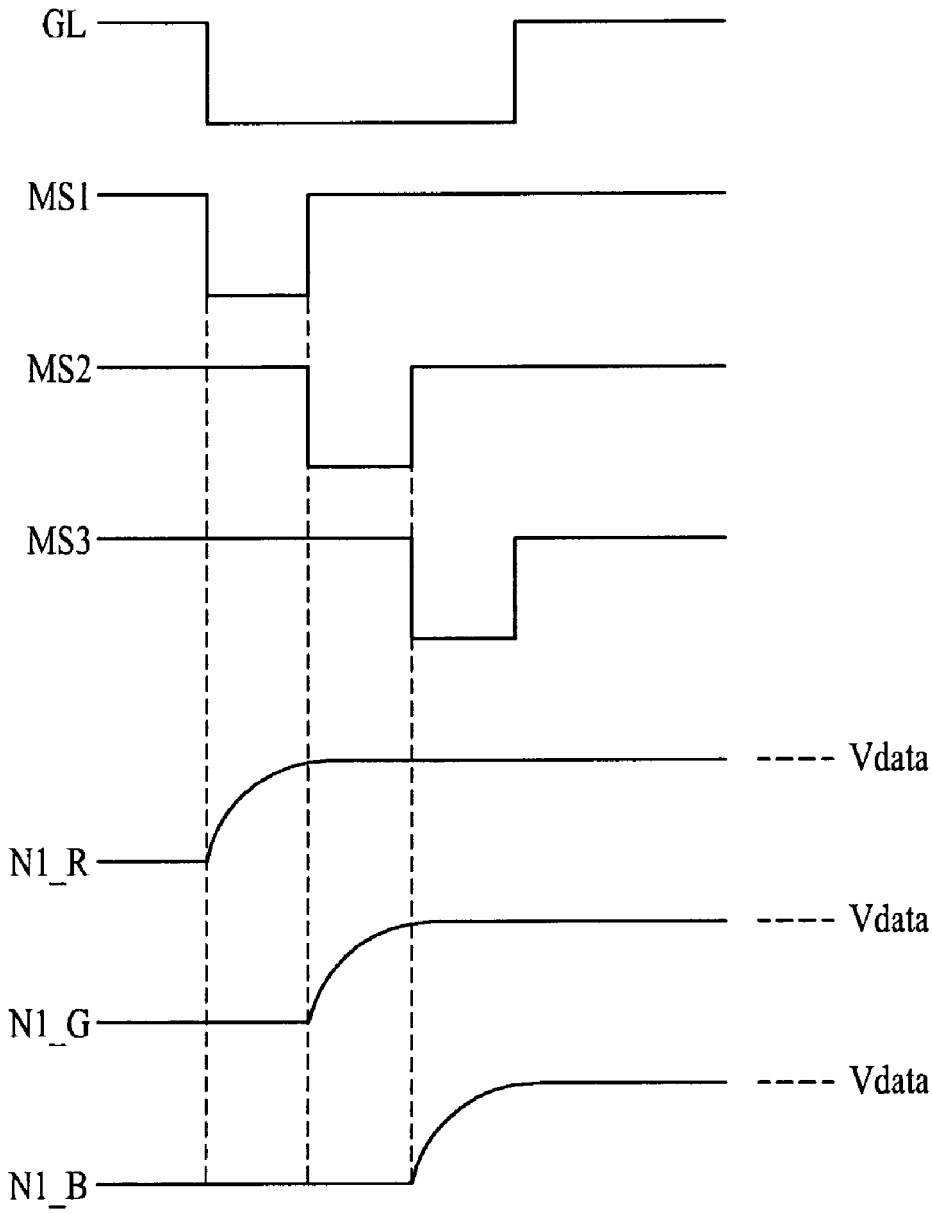
FIGS. 11A and 11B are waveform diagrams illustrating data supply times in the case where sampling transistors are turned on in a scan period and data supply times in the case where the sampling transistors are turned on in a data input period, respectively.

More particularly, during the scan period PS of the gate line GLn of the current stage, the first to third sampling transistors MT1 to MT3 are sequentially turned on in response to the first to third sampling control signals MS1 to MS3, as shown in FIG. 11A. In this case, data voltages are sequentially supplied to pixel cells corresponding respectively to the first to third sampling transistors MT1 to MT3. In this case, supply times of data voltages Vdata to the first nodes N1 are as follows. That is, because the first sampling transistor MT1 is turned on first of all, a supply time of a data voltage Vdata to a pixel cell connected with the first sampling transistor MT1 is longer than the supply times of data voltages Vdata to pixel cells connected with the second and third sampling transistors MT2 and MT3. As a result, at a predetermined time, a data voltage Vdata is normally supplied to the first node N1 of the pixel cell corresponding to the first sampling transistor MT1, whereas data voltages Vdata failing to reach desired levels are supplied to the first nodes N1 of the pixel cells corresponding to the second and third sampling transistors MT2 and MT3, thereby causing the picture quality to be uneven.

Figure 11B:
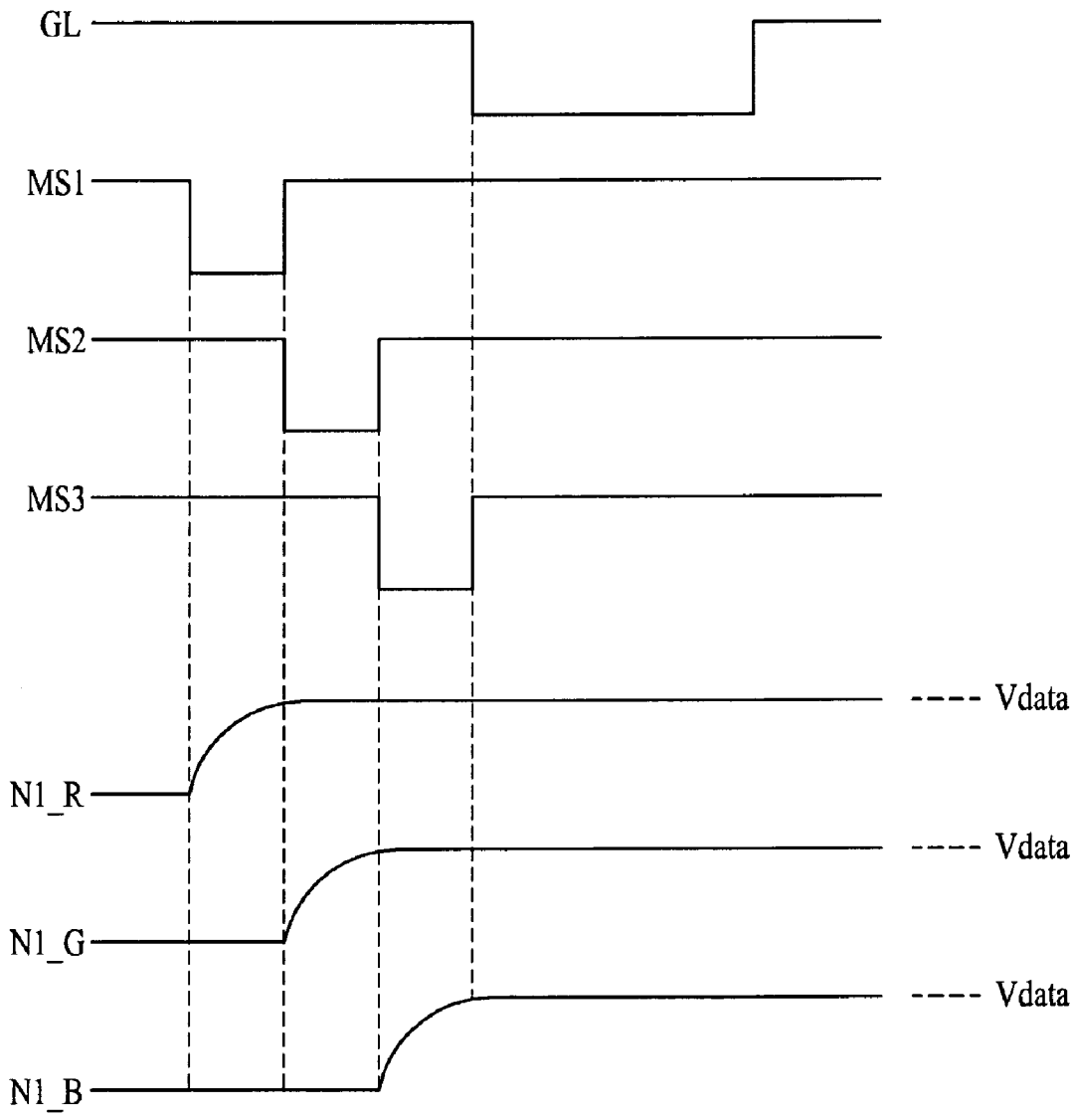

In contrast, in the data input period PI between the scan period PS of the gate line GLn-1 of the previous stage and the scan period PS of the gate line GLn of the current stage, the first to third sampling transistors MT1 to MT3 are sequentially turned on in response to the first to third sampling control signals MS1 to MS3, as shown in FIG. 11B. As a result, data voltages Vdata are precharged in the respective data lines DL through the first to third sampling transistors MT1 to MT3. Thereafter, when the low-logic gate voltage is supplied to the gate line GLn of the current stage, the data voltages Vdata are simultaneously supplied to the respective pixel cells. In this case, because the precharged data voltages Vdata are simultaneously supplied to the respective pixel cells in the data input period, the picture quality is even.

As apparent from the above description, in an OLED display and a driving method thereof according to the present invention, data voltages sequentially supplied through one output line are supplied to a plurality of data lines using a demultiplexer unit. The data voltages supplied to the plurality of data lines are simultaneously supplied to respective pixel cells through first switching transistors. Therefore, it is possible to display an image of even brightness.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An OLED display comprising:

an OLED display panel including:

data lines to which data voltages are supplied;

gate lines to which a gate voltage is sequentially supplied;

luminescence control lines to which a luminescence control voltage is sequentially supplied, a driving power line to which a driving voltage is supplied;

a compensation power line to which a compensation voltage having a first level and a second level different from the first level are supplied;

a plurality of pixel cells each respectively in pixel areas defined by the data lines and the gate lines;

a data driver having output lines whose number is smaller than the number of the data lines; and a demultiplexer unit formed between the data driver and the OLED display panel, the demultiplexer unit supplying the data voltages from the output lines to the data lines, wherein each of the pixel cells includes:

a light emitting element; and a pixel driver that supplies a current corresponding to a corresponding one of the data voltages to the light emitting element based on the corresponding data voltage, the gate voltage, the luminescence control voltage, the driving voltage and the compensation voltage having the first level and that turns off the light emitting element when the compensation voltage has the second level, wherein the compensation voltage of the first level is supplied in a first period of one frame and the compensation voltage of the second level is supplied in a second period of the frame, the first period including a data input period and the scan period alternately repeated, and the second period being a remaining period of the one frame other than the first period.

2. The OLED display according to claim 1, wherein the pixel driver comprises:

a driving transistor that supplies current corresponding to a voltage at a gate electrode thereof to the light emitting element using the driving voltage;

a first switching transistor that supplies the corresponding data voltage to a first node in response to the gate voltage;

a second switching transistor that connects the gate electrode of the driving transistor to a source electrode or drain electrode of the driving transistor in response to the gate voltage;

a third switching transistor that connects the driving transistor to the light emitting element in response to the luminescence control voltage;

a fourth switching transistor that supplies the compensation voltage with the first level to the first node in response to the luminescence control voltage; and a capacitor connected between the first node and a second node connected to the gate electrode of the driving transistor.

3. The OLED display according to claim 2, wherein the pixel driver further comprises a fifth switching transistor that supplies an initialization voltage to the second node in response to the gate voltage supplied to a gate line of a previous stage.

4. The OLED display according to claim 2, wherein a capacitance of the data line is ten times greater than a capacitance of the storage capacitor.

5. The OLED display according to claim 1, wherein the demultiplexer unit partitions the data lines into a plurality of data line groups, the demultiplexer unit comprising a plurality of demultiplexers each including a plurality of sampling transistors connecting a corresponding one of the output lines of the data driver to a corresponding one of the data line groups.

6. The OLED display according to claim 5, wherein the sampling transistors are sequentially turned on in the data input period between a scan period of a gate line of a previous stage and a scan period of a gate line of a current stage to sequentially supply corresponding ones of the data voltages to data lines of the corresponding data line group.

7. The OLED display according to claim 1, wherein the compensation voltage with the first level is the same as the driving voltage and the compensation voltage with the second level is the same as a black data voltage.

8. A driving method for an OLED display, the OLED display including an OLED display panel having a plurality of pixel cells formed respectively in pixel areas defined by data lines to which data voltages are supplied, gate lines to which a gate voltage is sequentially supplied, luminescence control lines to which a luminescence control voltage is sequentially supplied, a driving power line to which a driving voltage is supplied, and a compensation power line to which compensation voltages of a first level and a second level different from the first level are supplied, the method comprising:

supplying the data voltages from a data driver to the data lines through a demultiplexer unit between the data driver and the OLED display panel, the data driver having output lines whose number is smaller than the number of the data lines;

sequentially supplying the gate voltage to the gate lines;

supplying current corresponding to a corresponding one of the data voltages to a light emitting element of each of the pixel cells based on the luminescence control voltage, the driving voltage and the compensation voltage with the first level to turn on the light emitting element; and turning off the light emitting element based on the compensation voltage with the second level, wherein the compensation voltage of the first level is supplied in a first period of one frame and the compensation voltage of the second level is supplied in a second period of the frame, the first period including a data input period and the scan period alternately repeated, and the second period being a remaining period of the one frame other than the first period.

9. The driving method of claim 8, wherein multiplexer driving signals that sequentially supply data voltages from the data driver to the data lines are on simultaneously while the gate line signal is on.

10. The driving method of claim 8, wherein multiplexer driving signals that sequentially supply data voltages from the data driver to the data lines are on prior to the gate line signal being on.

11. The driving method according to claim 8, wherein the step of turning on the light emitting element comprises:

supplying the corresponding data voltage to a first node through a first switching element turned on by the gate voltage, and connecting a gate electrode of a driving transistor to a source electrode or drain electrode of the driving transistor through a second switching element turned on by the gate voltage to sample a threshold voltage of the driving transistor at a second node, the driving transistor outputting a driving current corresponding to the corresponding data voltage;

connecting the driving transistor to the light emitting element through a third switching element turned on by the luminescence control voltage, and supplying the compensation voltage with the first level to the first node through a fourth switching element turned on by the luminescence control voltage; and turning on the driving transistor based on a voltage at the second node varying by a voltage variation at the first node through a capacitor connected between the first node and the second node to output the driving current.

12. The driving method according to claim 11, wherein the step of turning off the light emitting element comprises:

supplying the compensation voltage with the second level to the fourth switching element; and turning off the driving transistor based on a voltage at the second node varying according to a voltage variation at the first node based on the compensation voltage of the second level through the capacitor.

13. The driving method according to claim 11, further comprising, before supplying the data voltages to the data lines through the demultiplexer unit, supplying an initialization voltage to the second node through a fifth switching element turned on by the gate voltage supplied to a gate line of a previous stage.

14. The driving method according to claim 8, wherein the demultiplexer unit partitions the data lines into a plurality of blocks, the demultiplexer unit comprising a plurality of demultiplexers each including a plurality of sampling transistors connecting a corresponding one of the output lines of the data driver to a corresponding one of the blocks, wherein the step of supplying the data voltages to the data lines through the demultiplexer unit includes sequentially turning on the sampling transistors in the data input period between a scan period of a gate line of a previous stage and a scan period of a gate line of a current stage to sequentially supply corresponding ones of the data voltages to data lines of the corresponding block.

15. The driving method according to claim 8, wherein a capacitance of the data line is ten times greater than a capacitance of the storage capacitor.

16. An OLED display comprising:

an OLED display panel including:

data lines to which data voltages are supplied;

gate lines to which a gate voltage is sequentially supplied;

luminescence control lines to which a luminescence control voltage is sequentially supplied, a driving power line to which a driving voltage is supplied;

a compensation power line to which a compensation voltage having a first level and a second level different from the first level are supplied;

a plurality of pixel cells each respectively in pixel areas defined by the data lines and the gate lines;

a data driver having output lines whose number is smaller than the number of the data lines; and a demultiplexer unit formed between the data driver and the OLED display panel, the demultiplexer unit supplying the data voltages from the output lines to the data lines, wherein each of the pixel cells includes:

a light emitting element; and a pixel driver that supplies a current corresponding to a corresponding one of the data voltages to the light emitting element based on the corresponding data voltage, the gate voltage, the luminescence control voltage, the driving voltage and the compensation voltage having the first level and that turns off the light emitting element when the compensation voltage has the second level, wherein the pixel driver includes:

a driving transistor that supplies current corresponding to a voltage at a gate electrode thereof to the light emitting element using the driving voltage;

a first switching transistor that supplies the corresponding data voltage to a first node in response to the gate voltage;

a second switching transistor that connects the gate electrode of the driving transistor to a source electrode or drain electrode of the driving transistor in response to the gate voltage;

a third switching transistor that connects the driving transistor to the light emitting element in response to the luminescence control voltage;

a fourth switching transistor that supplies the compensation voltage with the first level to the first node in response to the luminescence control voltage; and a capacitor connected between the first node and a second node connected to the gate electrode of the driving transistor;

wherein the compensation voltage of the first level is supplied in a first period of one frame and the compensation voltage of the second level is supplied in a second period of the frame, the first period including a data input period and the scan period alternately repeated, and the second period being a remaining period of the one frame other than the first period.

17. The OLED display according to claim 16, wherein the pixel driver further comprises a fifth switching transistor that supplies an initialization voltage to the second node in response to the gate voltage supplied to a gate line of a previous stage.

18. The OLED display according to claim 16, wherein the demultiplexer unit partitions the data lines into a plurality of data line groups, the demultiplexer unit comprising a plurality of demultiplexers each including a plurality of sampling transistors connecting a corresponding one of the output lines of the data driver to a corresponding one of the data line groups, wherein the sampling transistors are sequentially turned on in the data input period between a scan period of a gate line of a previous stage and a scan period of a gate line of a current stage to sequentially supply corresponding ones of the data voltages to data lines of the corresponding data line group.

19. The OLED display according to claim 16, wherein the compensation voltage with the first level is the same as the driving voltage and the compensation voltage with the second level is the same as a black data voltage.

20. The OLED display according to claim 19, wherein a capacitance of the data line is ten times greater than a capacitance of the storage capacitor.

* * * * *